US008317084B2

(12) United States Patent
Bagai

(10) Patent No.: US 8,317,084 B2
(45) Date of Patent: Nov. 27, 2012

(54) PACKAGE CONTENT CONTROL

(75) Inventor: Hitesh Bagai, Navi Mumbai (IN)

(73) Assignee: Nokia Corporation, Espoo (FI)

( * ) Notice: Subject to any disclaimer, the term of this patent is extended or adjusted under 35 U.S.C. 154(b) by 654 days.

(21) Appl. No.: 12/561,542

(22) Filed: Sep. 17, 2009

(65) Prior Publication Data

US 2011/0062227 A1 Mar. 17, 2011

(51) Int. Cl.
*G06F 17/00* (2006.01)

(52) U.S. Cl. ..... 235/375

(58) Field of Classification Search ..... 235/375
See application file for complete search history.

(56) References Cited

U.S. PATENT DOCUMENTS

2005/0237204 A1* 10/2005 Burman et al. ..... 340/572.8
2007/0001846 A1* 1/2007 August et al. ..... 340/571
2007/0108273 A1* 5/2007 Harper et al. ..... 235/382
2007/0241900 A1* 10/2007 Sasazaki ..... 340/572.1
2009/0303003 A1* 12/2009 Pritchard et al. ..... 340/10.1

OTHER PUBLICATIONS www.sciencedaily.com/releases/2008/10/081028132300.htm.
www.biblio-tech.com/BTR901/January 2001/e-ink for e-books.html.

* cited by examiner

*Primary Examiner* — Daniel Hess
*Assistant Examiner* — David Tardif
(74) *Attorney, Agent, or Firm* — Harrington & Smith

(57) ABSTRACT

A package for items, the package having a wireless communication unit configured to wirelessly receive identification information from data transmitters corresponding to the items within the package to which the apparatus is associated. The package further has a display and a processor configured to collect received identification information and to cause the display to display identification information of the items in the package. The wireless communication unit, the display and the processor are integrated into the structure of the package.

18 Claims, 2 Drawing Sheets

PACKAGE CONTENT CONTROL

TECHNICAL FIELD

The present application generally relate to package content control. The present application relate particularly, though not exclusively, to monitoring and displaying of contents of a package.

BACKGROUND ART

Various articles are packaged together in a common packaging for storage and delivery. For example, mobile phones are typically sold in cardboard boxes containing a mobile phone, a battery and charger. The contents of the package are sometimes identified on the packaging by means of a sticker with printed identifier(s) of the contents.

SUMMARY

According to a first example aspect of the invention there is provided an apparatus comprising:

a receiver configured to wirelessly receive identification information from data transmitters corresponding to items within a package to which the apparatus is associated; and a processor configured to collect received identification information and to cause displaying of identification information of the items in the package.

One of the items may be a mobile communication device. The identification information may comprise an international mobile equipment identity of the mobile communication device.

The apparatus may be adapted for integrating into the structure of the package. The apparatus may be adapted for laminating into the package.

The apparatus may comprise the display.

The display may be water-resistant.

The display may comprise a flat light emitting diode element. The display may comprise an organic light emitting diode element.

The apparatus may comprise a memory configured to store identifications of originally packaged items and to select identification of the originally packaged items for display while corresponding identification information is received.

The processor may be further configured to detect if the identification of an originally configured is no longer received and to cause displaying of an indication that an originally packaged item may be missing from the package.

The processor may be further configured to detect the identification and class of items from wireless transmissions received from the data transmitters. The processor may be further configured to detect if an item in one class is replaced with another and to cause displaying of the identification of the new item. The processor may be further configured to indicate with the display the classes associated with different items within the package. The processor may be further configured to indicate changed items with the display.

The apparatus may be configured to cause displaying of the identification information until the package is opened or at least one of the originally packaged items is removed from the package.

The apparatus may be configured to start displaying of the identification information responsive to a predetermined event. The predetermined event may comprise any one or more items from a group consisting of: producing the apparatus; the apparatus being powered; the apparatus receiving an initiation command; and particular date or time.

The apparatus may be configured to pause displaying of the identification information responsive to a predetermined event. The predetermined event may comprise any one or more items from a group consisting of: discontinuing of the powering of the apparatus; the apparatus receiving a pause command; and particular date or time.

The apparatus may be configured to switch off the display while the displaying of the identification information is paused.

The apparatus may be configured to receive commands over the wireless communication unit.

The apparatus may comprise a mobile power source. The mobile power source may comprise any one or more items from a group consisting of: a battery; solar cell; fuel cell; and wireless energy harvester.

The apparatus may be flexible. The apparatus may flex with a radius of 8 to 20 mm, particularly with a radius of 10 mm.

The wireless communication unit may be configured to communicate using a technology selected from a group consisting of: radio frequency identification communications, low power radio frequency communication, Bluetooth data communication and near field communication.

The wireless communication unit may be configured to wirelessly power the data transmitters.

According to a second example aspect of the invention there is provided a package for items, the package comprising:

a wireless communication unit configured to wirelessly receive identification information from data transmitters corresponding to the items within the package to which the apparatus is associated;

a display; and a processor configured to collect received identification information and to cause the display to display identification information of the items in the package;

wherein the wireless communication unit, the display and the processor are integrated into the structure of the package.

The display may be laminated between a corrugated board and an exterior paper lining.

The exterior paper lining may comprise an aperture configured to enable viewing the display through the aperture.

The wireless communication unit, the display and the processor may be integrated into a common apparatus.

The package may be configured to enable verifying the contents of the package without opening the package and checking the identifiers of each item within the package.

According to a third example aspect of the invention there is provided a method comprising:

wirelessly receiving identification information from data transmitters corresponding to items within a package; and collecting received identification information and causing displaying of identification information of the items in the package.

According to a fourth example aspect of the invention there is provided a computer program comprising computer executable program code configured to cause an apparatus to perform, when executing program:

wirelessly receiving identification information from data transmitters corresponding to items within a package; and collecting received identification information and causing displaying of identification information of the items in the package.

The computer program may be stored in a memory medium. The memory medium may comprise a digital data storage such as a data disc or diskette, optical storage, magnetic storage, holographic storage, opto-magnetic storage, phase-change memory, resistive random access memory, magnetic random access memory, solid-electrolyte memory, ferroelectric random access memory, organic memory or polymer memory. The memory medium may be formed into a device without other substantial functions than storing memory or it may be formed as part of a device with other functions, including but not limited to a memory of a computer, a chip set, and a sub assembly of an electronic device.

Different non-binding example aspects and embodiments of the present invention have been illustrated in the foregoing. The above embodiments are used merely to explain selected aspects or steps that may be utilized in implementations of the present invention. Some embodiments may be presented only with reference to certain example aspects of the invention. It should be appreciated that corresponding embodiments may apply to other example aspects as well.

BRIEF DESCRIPTION OF THE DRAWINGS

The invention will be described, by way of example only, with reference to the accompanying drawings, in which.

DETAILED DESCRIPTION

In the following description, like numbers denote like elements.

Figure 1:
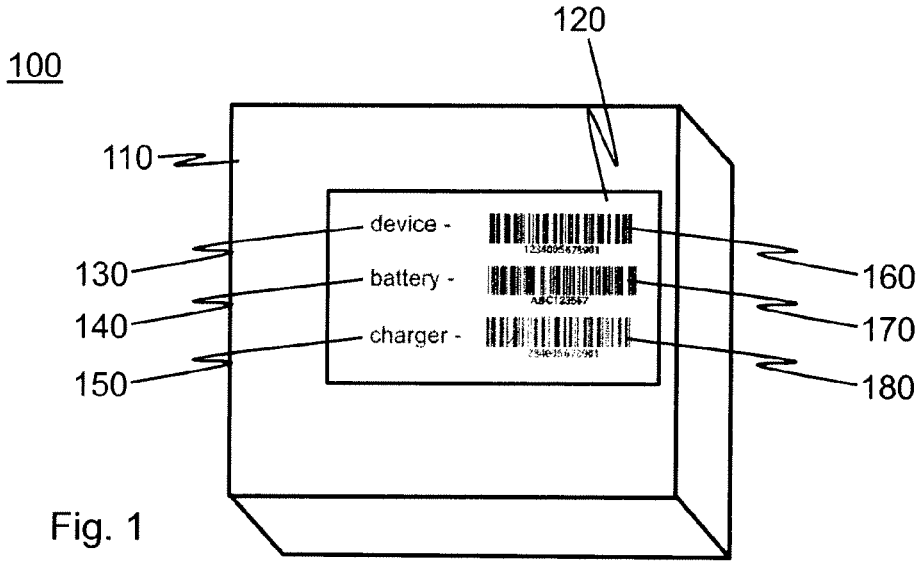
FIG. 1 shows a schematic picture of a package according to an example embodiment of the invention.

FIG. 1 shows a schematic picture of a package 100 of items according to a first example embodiment of the invention. The package 100 comprises a front wall 110 with an apparatus integrated in the front wall for display of information to a user, also referred to as an electronic label 120. The label 120 is configured to display different classes of contained products, such as a mobile communication device 130, battery 140 and charger 150 with associated identifiers 160 to 180.

In a second example embodiment applicable with the first example embodiment, the identifiers of the first example embodiment contain alpha-numeric characters and/or machine readable characters such as barcodes.

In a third example embodiment applicable with the first and second example embodiment the label is further configured to highlight any classes or identifiers in which the contained item has changed after the package has been originally packed.

Figure 4:
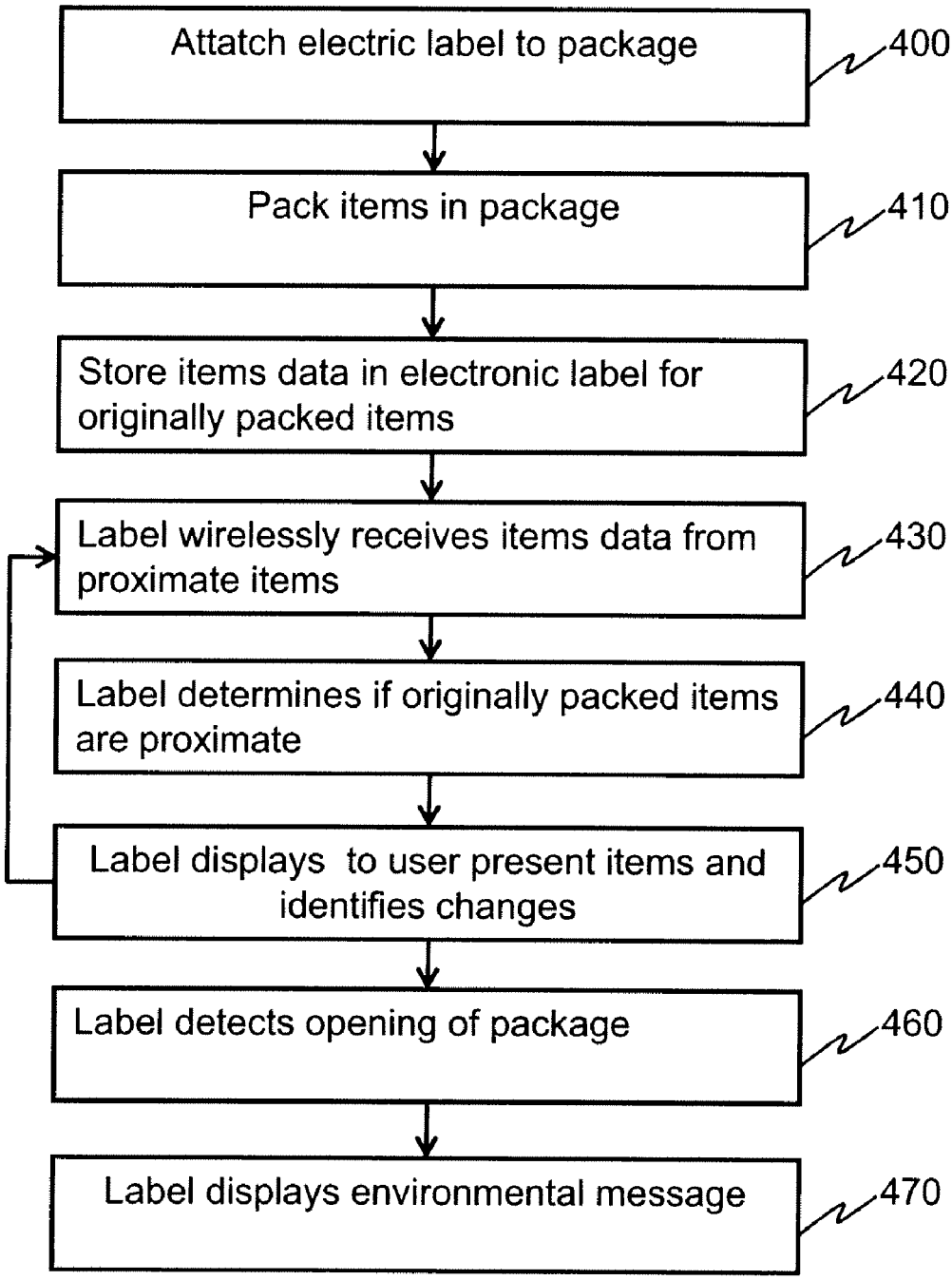
FIG. 4 shows a schematic flow chart of a process according to an example embodiment of the invention.

The use of identifiers and the operation of the label are explained with more detail in FIG. 4. Next, the structure of the package and label of the first example embodiment is described.

Figure 2:
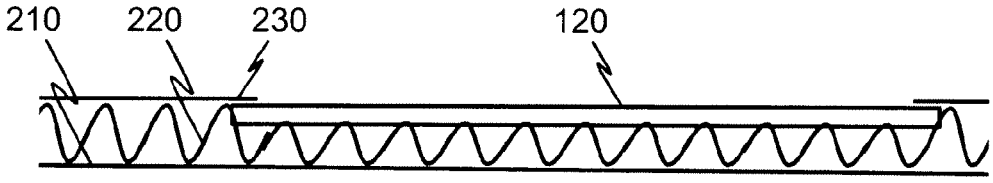
FIG. 2 shows a cross-section of particular details on a front wall of the package of FIG. 1.

FIG. 2 shows a cross-section of particular details on a front wall 110 of the package of FIG. 1. The front wall comprises a back lining 210 that is e.g. cardboard, a corrugated paper 220 and a front lining 230 as in common paper board. Unlike normal paper board, the front wall 110 also comprises an opening aligned with the electronic label 120 that has been attached on the corrugated paper 220. The electronic label is attached to the corrugated paper by gluing, for instance.

In a fourth example embodiment applicable with any of the first, second or third example embodiment, the electronic label 120 has been attached in a process in which the paper board has been manufactured by merging the three layers of the corrugated board with a roll nip. Prior merging, windows have been punctured in the front lining for the electronic label 120 and the electronic labels 120 have been laid onto the corrugated paper 220 before the front lining has been glued on the corrugated paper.

In a fifth example embodiment applicable with any one of the first to fourth example embodiment, the windows are dimensioned to enable insertion of the electronic label onto the corrugated paper 220 and the label 120 is pressed in the opening (window) flush with the front lining 230.

Figure 3:
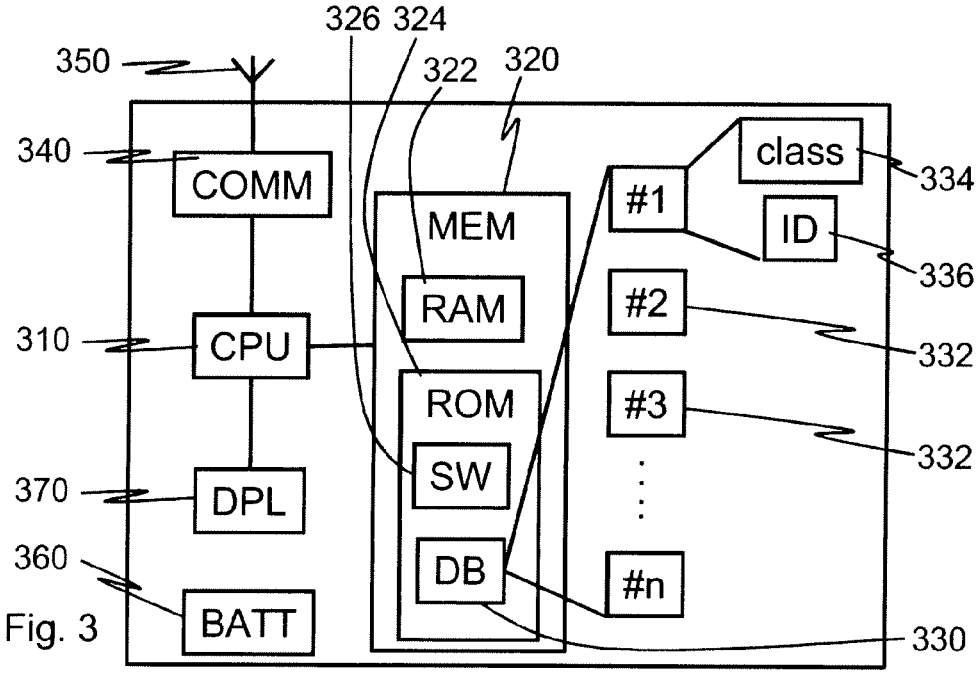
FIG. 3 shows a block diagram of an electronic label according to an example embodiment of the invention.

FIG. 3 shows a block diagram of an electronic label 120 according to a sixth example embodiment of the invention applicable with any one of the first to fifth example embodiment. The electronic label 120 comprises a processor 310 such as a central processing unit, digital signal processor, or master control processor. The electronic label further comprises a memory 320 with a work memory 322 such as random access memory, and with a persistent memory 324 such as a read-only memory. The persistent memory 324 comprises software code 326 or instructions according to which the processor may control the operation of the electronic label 120, and a database 330 of items data. The items data comprises a number of items data fields 332. Each items data field comprises, for instance, a class 334 of item and one or more identifiers 336 of the item.

In a seventh example embodiment of the invention applicable with the any one of the first to sixth example embodiment, the electronic label 120 further comprises a receiver 340 with an antenna 350. The receiver may be part of a communication module such as, radio frequency identification communication module, low power radio frequency communication module, Bluetooth data communication module and near field communication module.

In an eighth example embodiment of the invention applicable with any one of the first to seventh example embodiment, the communication module is configured to power proximate wireless devices by means of electro-magnetic waves.

In a ninth example embodiment of the invention applicable with any one of the first to eighth example embodiment, the electronic label 120 further comprises a power source 360 such as a battery, fuel cell, solar cell, and/or and wireless energy harvester. Moreover, the electronic label 120 further comprises a display 370 that is configured to display information to the user. The display is, for instance, formed of a flat led element.

The communication module of the eighth and ninth example embodiment may enable power the proximate wireless devices using the mobile power source of the electronic label so that the electronic label 120 can readily indicate the contents of the associated package. Moreover, the label may be constantly carried along with the package so that the label can also indicate if any one of the items in the package has been changed while the electronic label 120 has been monitoring the presence of the associated items.

In a tenth example embodiment of the invention applicable with any one of the first to ninth example embodiment, the display is configured to form alpha-numeric characters out of different independently operable character segments.

FIG. 4 shows a schematic flow chart of a process according to an eleventh example embodiment of the invention applicable with any one of the first to tenth example embodiment. In the process, an electronic label 120 is attached 400 to a package 100. One or more products are packed 410 in a package. Items data of the packed items is stored 420 in the electronic label 120 for later use to compare whether any changes have take place with contained items, e.g. to avoid unauthorized borrowing of the packed items.

When the items are in the package, the electronic label 120 continually receives 430 wirelessly items data from proximate items. This receiving occurs, for instance, by using radio frequency identification such that the communication module 340 powers proximate radio frequency identification units and responsively receives identification information including, for each item, a class of the item and one or more identifiers. Armed with the wirelessly received items data, the electronic label 120 checks 440 using the stored items data which of the originally packed items are still present. The electronic label 120 displays 450 to the user the present items so that if any item is missing or has been missing, that item is highlighted so that the user may immediately detect that the contents of the package have been changed at least for a while between the packing of the package and the present time.

In a twelfth example embodiment of the invention applicable with any one of the first to eleventh example embodiment, the electronic label 120 further detects opening 460 of the package and responsively presents 470 one or more predetermined messages, such as an environmental advice concerning appropriate manner to recycle the package and/or the items in the package after use.

In a thirteenth example embodiment of the invention applicable with any one of the first to twelfth example embodiment, the electronic label 120 supervises that the contents of the package are not changed as long as the electronic label 120 is powered.

In a fourteenth example embodiment of the invention applicable with any one of the first to thirteenth example embodiment, the electronic label 120 has a relatively long operation period so that normally the package should no longer be at least on sale if or when the electronic label 120 runs out of power. However, there are different ways to spare energy. For instance, in a fifteenth embodiment of the invention applicable with any one of the first to fourteenth example embodiment, the electronic label 120 is configured to check the presence of different items in the package with given intervals such as once a minute or once in an hour, for instance. Moreover, or alternatively, in a sixteenth embodiment of the invention applicable with any one of the first to fifteenth example embodiment, the electronic label 120 is initially powered with the originally packed items data and the power supply of the electronic label 120 may be isolated from the electronic label 120 e.g. by means of a removable circuit breaker such as a strip of isolating paper or plastics. For the period when the original packed items data are to be stored, the electronic label 120 is powered using temporary measures in a seventeenth embodiment of the invention applicable with any one of the first to sixteenth example embodiment. The temporary measures involve, for instance, providing the electronic label 120 with a wireless energy harvester and feeding energy to the wireless energy harvester. For instance, in an eighteenth embodiment of the invention applicable with any one of the first to seventeenth example embodiment, the electronic label 120 comprises a coil to inductively receive desired voltage from a suitably alternating electric field that is produced on packing the package. The wireless energy harvester comprises, for instance, an antenna or coil. In a nineteenth embodiment of the invention applicable with any one of the first to eighteenth example embodiment, the coil further doubles as a theft indicator configured to trigger anti-theft gates commonly present in commodity stores.

In a twentieth example embodiment of the invention applicable with any one of the first to nineteenth example embodiment, the data in the memory of the electronic label 120 is encrypted so as to hinder unauthorized tampering of the software and/or database contents of the electronic label 120. The encryption may provide a degree of piracy protection.

In a twenty-first example embodiment of the invention applicable with any one of the first to twentieth example embodiment, the electronic label 120 is configured to start displaying of the identification information responsive to a predetermined event. The predetermined event may comprise, for instance, any one or more items from a group consisting of: producing the apparatus; the apparatus being powered; the apparatus receiving an initiation command; and particular date or time.

In a twenty-second example embodiment of the invention applicable with any one of the first to twenty-first example embodiment, the electronic label 120 is configured to pause displaying of the identification information responsive to a predetermined event. The predetermined event may comprise any one or more items from a group consisting of: discontinuing of the powering of the apparatus; the apparatus receiving a pause command; and particular date or time.

In a twenty-third example embodiment of the invention applicable with any one of the first to twenty-second example embodiment, the electronic label 120 is configured to switch off the display while the displaying of the identification information is paused.

In a twenty-fourth example embodiment of the invention applicable with any one of the first to twenty-third example embodiment, the electronic label 120 is configured to receive commands over the wireless communication unit.

In a twenty-fifth example embodiment of the invention applicable with any one of the first to twenty-fourth example embodiment, the electronic label 120 apparatus is flexible.

The foregoing description has provided by way of non-limiting examples of particular implementations and embodiments of the invention a full and informative description of the best mode presently contemplated by the inventors for carrying out the invention. It is however clear to a person skilled in the art that the invention is not restricted to details of the embodiments presented above, but that it can be implemented in other embodiments using equivalent means or in different combinations of embodiments without deviating from the characteristics of the invention.

Furthermore, some of the features of the above-disclosed embodiments of this invention may be used to advantage without the corresponding use of other features. As such, the foregoing description shall be considered as merely illustrative of the principles of the present invention, and not in limitation thereof. Hence, the scope of the invention is only restricted by the appended patent claims.

I claim:

1. An apparatus comprising:

a wireless receiver configured to wirelessly receive identification information from data transmitters corresponding to items within a package with which the apparatus is associated;

a display laminated between a corrugated board and an exterior paper lining of the package, the display being observable through the exterior paper lining; and a processor configured to cause collecting of the received identification information and to cause displaying of the identification information of the items in the package on the display.

2. The apparatus of claim 1, wherein one of the items is a mobile communication device.

3. The apparatus of claim 2, wherein the identification information comprises an international mobile equipment identity of the mobile communication device.

4. The apparatus of claim 1, wherein the apparatus is adapted for integrating into a structure of the package.

5. The apparatus of claim 1 wherein the display comprises a flat light emitting diode element.

6. The apparatus of claim 1, wherein the apparatus comprises a memory configured to store identifications of originally packaged items and to select identification of the originally packaged items for display while corresponding identification information is received.

7. The apparatus of claim 1, wherein the processor is further configured to detect if the identification of an originally packaged item is no longer received and to cause displaying of an indication that the originally packaged item may be missing from the package.

8. The apparatus of claim 1, wherein the processor is further configured to cause displaying of an indication of changed items on the display.

9. The apparatus of claim 1, wherein the apparatus is configured to display the identification information until the package is opened or at least one of the originally packaged items is removed from the package.

10. The apparatus of claim 1, wherein the wireless receiver is configured to wirelessly power the data transmitters.

11. A package for items, the package comprising:

a wireless communication unit configured to wirelessly receive identification information from data transmitters corresponding to the items within the package with which the apparatus is associated;

a display laminated between a corrugated board and an exterior paper lining of the package, the display being observable through the exterior paper lining; and a processor configured to cause collecting of received identification information and to cause the display to display identification information of the items in the package;

wherein the wireless communication unit, the display, and the processor are integrated into a structure of the package.

12. The package of claim 11, wherein the wireless communication unit, the display and the processor are integrated into a common apparatus.

13. A method comprising:

wirelessly receiving identification information from data transmitters corresponding to items within a package; and collecting received identification information; and displaying the identification information of the items within the package on a display laminated between a corrugated board and an exterior paper lining, the display being observable through the exterior paper lining.

14. The method of claim 13, further comprising detecting if the identification of an originally packaged item is no longer received and displaying an indication that the originally packaged item may be missing from the package.

15. The method of claim 13 further comprising displaying of an indication of changed items.

16. The method of claim 13 further comprising displaying of the identification information until the package is opened or at least one of the originally packaged items is removed from the package.

17. The method of claim 13 further comprising the wireless communication unit being configured to wirelessly power the data transmitters.

18. A computer program comprising computer executable program code configured to cause an apparatus to perform, when executing program:

wirelessly receiving identification information from data transmitters corresponding to items within a package; and collecting received identification information; and causing displaying of the identification information of the items in the package on a display laminated between a corrugated board and an exterior paper lining, the display being observable through the exterior paper lining.

* * * * *